United States Patent [19]

Schmidt et al.

[11] 4,085,406

[45] Apr. 18, 1978

[54] SPIRAL ANTENNA ABSORBER SYSTEM

[75] Inventors: John Michael Schmidt; Wallace Leon Snow, both of Apalachin, N.Y.

[73] Assignee: International Business Machines Corporation, Armonk, N.Y.

[21] Appl. No.: 734,851

[22] Filed: Oct. 22, 1976

[51] Int. Cl.[2] ..... H01Q 1/36; H01Q 1/42

[52] U.S. Cl. ..... 343/895; 343/789

[58] Field of Search ..... 343/895, 789, 909

[56] References Cited

U.S. PATENT DOCUMENTS

| | | | |
|---|---|---|---|
| 3,192,531 | 6/1965 | Cox et al. | 343/789 |
| 3,624,658 | 11/1971 | Voronoff | 343/895 |
| 3,945,016 | 3/1976 | Bizouard et al. | 343/895 |

*Primary Examiner*—Alfred E. Smith
*Assistant Examiner*—Harry E. Barlow
*Attorney, Agent, or Firm*—Norman R. Bardales

[57] ABSTRACT

The radiation absorber system of a unidirectional spiral antenna is provided with a laterally transverse variable radiation absorption density characteristic to control the absolute gain with frequency pattern, i.e. absolute gain versus frequency characteristic, of the antenna.

6 Claims, 12 Drawing Figures

SPIRAL ANTENNA ABSORBER SYSTEM

The invention herein described was made in the course of, or under a contract, or subcontract thereunder, with the Department of the Navy.

BACKGROUND OF THE INVENTION (1) Field of the Invention

This invention relates to unidirectional spiral antennae and more particularly to radiation absorber systems associated therewith.

(2) Description of the Prior Art

It is well-known in the prior art to employ a reflector cavity with a spiral antenna so as to render the antenna unidirectional, cf. U.S. Pat. Nos. 3,192,531; 3,358,288; 3,441,937; 3,555,554; 3,686,674; 3,781,898; 3,820,117 and 3,969,732, for example.

It is also well-known in the prior art to provide radiation absorber systems in such reflector cavities. Thus, for example, a plurality of triangular-shaped absorber card attenuators are positioned radially and symmetrically in a radial finlike member in the reflector cavity of the spiral antenna of U.S. Pat. No. 3,192,531. A microwave absorber liner either in layer or discrete member form is used to cover the entire peripheral and bottom inner walls of the cylindrical reflector cavities of the antennae of U.S. Pat. Nos. 3,441,937 and 3,820,117. In a similar manner, the cavity chamber floor of the antenna of U.S. Pat. No. 3,781,898 is provided with a discrete absorber member. In U.S. Pat. Nos. 3,555,554 and 3,686,674 one or more spaced concentric radiation absorber members are disposed in the reflector cavities disclosed therein.

As used herein, the radiation absorption density characteristic refers to the density of the absorber material particles used to absorb the rf radiation. Lossy materials suitable for this purpose are, for example, Eccosorb ® SF-11, manufactured by Emmerson and Cumming of Camden, Massachusetts, dispersed in a silicon rubber matrix, cf. U.S. Pat. No. 3,441,937; graphite particles impregnated in a dielectric sheet, cf. U.S. Pat. No. 3,555,554; ferrite particles suspended in an epoxy, cf. "Casting Terminators For High-Frequency Antennae," S. M. Cole, IBM ® Technical Disclosure Bulletin, Vol. 18, No. 8, January 1976, page 2475. Also as used herein, laterally transverse refers to a direction substantially normal to the associated unidirectional axis of the antenna and longitudinal refers to a direction substantially parallel to it.

In each of the absorber systems of the aforedescribed prior art, the laterally or radially transverse radiation absorption density characteristic of each of the individual absorber members thereof is the same, i.e. uniform, and was equal to its longitudinal radiation absorption density characteristic. Hence, both the lateral and longitudinal density characteristics of the absorber system were the same and invariable for a given member. As a result, the control of the associated antenna's absolute gain versus frequency characteristic was limited to varying the dimension parameters of the various absorber components and/or of the cavity.

In another prior art device, the radiation absorber system is composed of plural radiation absorber members which are vertically, i.e. longitudinally, stacked in the reflector cavity of the antenna. While the absorber components of this particular absorber system have different radiation absorption density characteristics, the lateral radiation absorption density characteristic for any particular component and/or of the composite system is still uniform. That is to say, in this particular prior art device while the composite longitudinal radiation absorption density characteristic of the absorber system was variable, its corresponding lateral characteristic was uniform. Thus, this particular system was also limited in the manner in which it could control the antenna pattern, i.e. its absolute gain versus frequency characteristic. In addition, those members remote from the cavity opening were not readily accessible for removal, replacement, etc. without first removing the intervening members and thereby increased the time and cost in maintaining, servicing, etc. the antenna. Moreover, where the individual absorber members of this particular device have to be arranged in the cavity in accordance with a predetermined radiation absorption density characteristic sequence in the vertical direction, it was possible to assemble the individual members, all of which being of the same diameter, in an undesirable density characteristic sequence.

SUMMARY OF THE INVENTION

It is an object of this invention to provide a unidirectional spiral antenna having a radiation absorber system which controls the absolute gain versus frequency characteristic of the antenna.

It is another object of this invention to provide a unidirectional spiral antenna having a radiation absorber system with a lateral variable radiation absorption density characteristic.

Another object of this invention is to provide a unidirectional spiral antenna of the type described which has a standard reflector cavity and which is capable of selectively having different variable lateral radiation absorption density characteristics and, hence, different antenna patterns.

According to one aspect of the invention, a unidirectional spiral antenna has spiral antenna circuit means and insulator means for supporting the circuit means. In addition, electrical connector means are coupled to the circuit means, and electrically conductive reflector cavity means are juxtaposed adjacent to the support means. Radiation absorber means are disposed in the cavity means and the radiation absorber means has a predetermined lateral variable radiation absorption density characteristic.

The foregoing and other objects, features and advantages of the invention will be apparent from the following more particular description of a preferred embodiment of the invention, as illustrated in the accompanying drawing.

BRIEF DESCRIPTION OF THE DRAWING

In the FIGS., like elements are designated with similar reference numerals.

DESCRIPTION OF THE PREFERRED EMBODIMENTS

Figure 1:
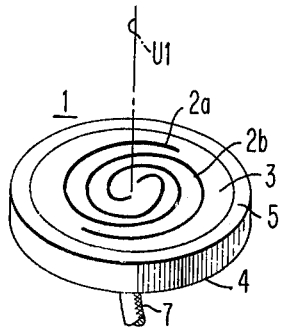
FIG. 1 is a perspective schematic view of a simplified embodiment of the present invention.
Figure 2:
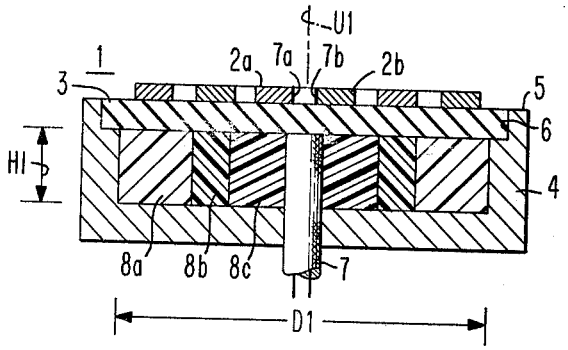
FIG. 2 is a cross-sectional, enlarged view of the embodiment of FIG. 1 illustrating the absorber system thereof.
Figure 3:
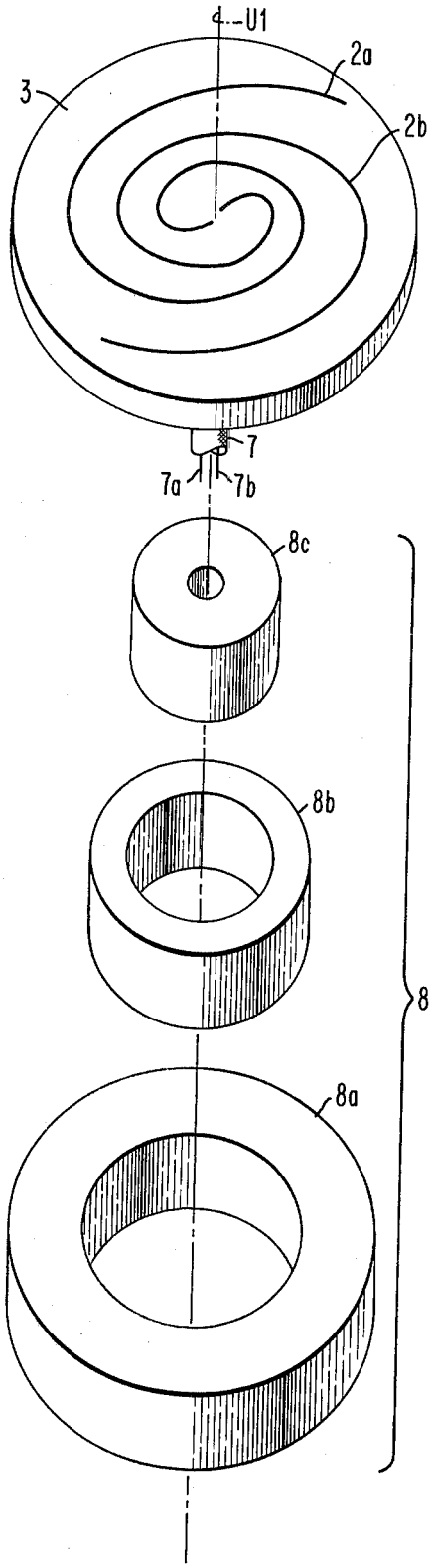
FIG. 3 is an exploded partial view of the embodiment of FIG. 1.

Referring to FIGS. 1 - 3, there is schematically shown one embodiment of the unidirectional spiral antenna of the present invention. The antenna 1 has spiral antenna circuit means comprised as two coplanar interleaved spiral-configured conductors *2a, 2b* supported on an insulator 3. Preferably, conductors *2a, 2b* are printed circuit conductors formed on a circular planar dielectric printed circuit board substrate 3 using conventional printed circuit techniques. An electrical conductive, i.e. copper, reflector cavity 4 is juxtaposed adjacent to the substrate 3 and has a general cylindrical configuration. For sake of clarity, cavity 4 is omitted in FIG. 3. The upper open end 5 of the cavity 4 has an inner recess or groove 6, cf. FIG. 2. Substrate 3 is mounted at its periphery in recess 6. Electrical connector means, shown schematically in FIG. 2 as an insulated two wire cable 7 for sake of clarity, has its wires *7a, 7b*, cf. FIG. 2, connected, e.g. by solder, to the printed circuit conductors *2a, 2b* and passes through the center of substrate 3 which is aligned with the longitudinal center of the cavity 4. Other suitable electrical connector means are, for example, coaxial connectors and/or cables and the like as is well-known to those skilled in the art.

In accordance with the principles of the present invention, a radiation absorber system 8 is provided in the spiral antenna reflector cavity 4 which has a lateral variable radiation absorption density characteristic with respect to the unidirectional axis U1 of the antenna 1. In each of the preferred embodiments of FIGS. 1 - 8, the absorber systems are configured as at least one layer of plural concentric absorber members, at least two members of at least one of the layers having different radiation absorption density characteristics. Thus, in the embodiment of FIGS. 1 - 3, there is shown an absorber system 8 configured as a single layer of three concentric ringlike cylindrical absorber members *8a, 8b, 8c*, and preferably having successively increasing radiation absorption density levels going from the outer member *8a* to the inner member *8c*.

Figure 2A:
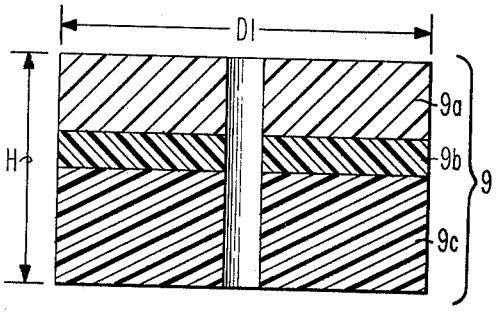
FIG. 2A (PRIOR ART)
FIG. 2A is a cross-sectional schematic view of a prior art device shown for sake of comparison.

By way of comparison, there is shown in FIG. 2A an absorber system 9 built in accordance with the principles of the aforedescribed prior art device. System 9 has three longitudinally aligned circular absorber members *9a, 9b, 9c*. Thus, as is apparent to those skilled in the art, while the absorber system 9 has a radiation absorption density characteristic which is variable longitudinally, it has a fixed or invariable lateral transverse radiation absorption density characteristic for any individual layer *9a, 9b, 9c* or the composite thereof.

In the present invention, should it be desired to change the absolute gain versus frequency characteristic, it would be generally only necessary to change one or more of the component members *8a–8c*, for one or more other components with the desired radiation absorption density characteristic(s) without necessarily changing the cavity dimensions. Thus, the cavity size can be standardized to accommodate different absorber systems of the same diameter D1 and height H1, but with different lateral radiation absorber density characteristics. On the other hand, in the prior art device of FIG. 3, changes in the antenna pattern sometimes require changes in the height H, for example, of the absorber system and corresponding changes in the height of the cavity. In this manner, a standardized cavity in the present invention is more versatile than that of the prior art device.

Moreover, in accordance with the present inventive principles, by varying the radiation absorption density in the lateral direction, the antenna gain can be more readily controlled by judiciously providing a specific density for each absorber part of the system that is compatible to the portion of the frequency bandwidth of the antenna with which it is to be associated. Thus, for a certain antenna gain characteristic of the antenna 1, the low, medium and high radiation absorption density characteristics of members *8a, 8b, 8c*, respectively, are matched to successive predetermined low, intermediate and high frequency sub-bands *fa, fb, fc* of the overall bandwidth flo to *fhi* of antenna 1, as hereinafter explained in greater detail. For purposes of illustration, the embodiment of FIG. 1 has three absorber components *8a–8c* and three corresponding sub-bands *fa–fc*. It should be understood, however, that for the given diameter D1 two or more concentric members may be utilized for two or more corresponding sub-bands and hence, providing even greater versatility to the cavity 4, if it is standardized.

Furthermore, as can be seen from the comparison of FIGS. 2 and 2A, the concentric absorber members *8a, 8b, 8c* of FIG. 2 are more readily accessible than the vertically stacked members *9a, 9b, 9c* of FIG. 2A.

Figure 4:
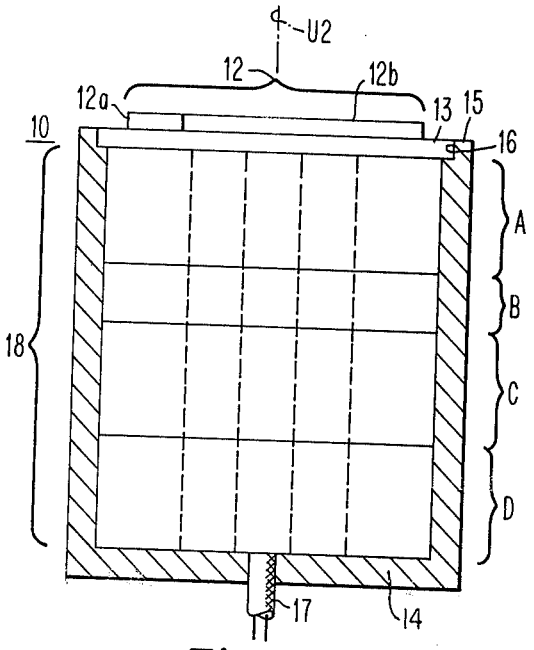
FIG. 4 is a partial cross-sectional view of another embodiment of the present invention.
Figure 5:
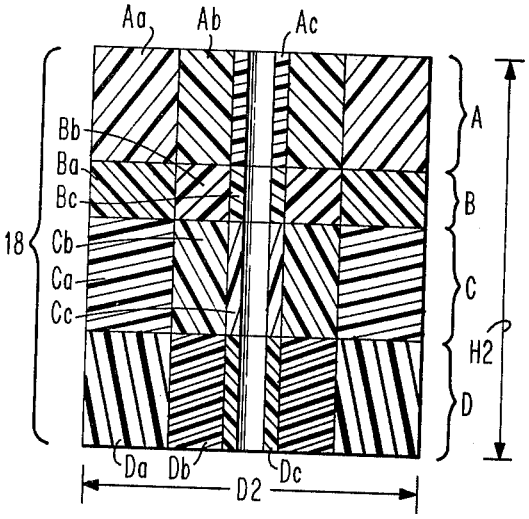
FIG. 5 is a more detailed cross-sectional view of the absorber system of FIG. 4.

Referring now to FIGS. 4 - 5, there is shown an antenna 10 having a spiral antenna circuit 12 on a circular dielectric substrate 13 and a unidirectional axis U2. Antenna 10 has a cylindrical reflector cavity 14 of a suitable conductor material, e.g. copper. The substrate 13 is mounted at the open end 15 of cavity 14 in a groove 16 provided for this purpose similar to the arrangement of corresponding elements 3, 4, 5, 6 of the antenna 1 of FIGS. 1 - 3. A suitable connector 17 shown schematically as a two-wire conductor 17 for sake of simplicity, is connected to the antenna spiral conductors *12a, 12b*.

In the embodiment of FIGS. 4 - 5, the absorber system 18 is comprised of four multilayers, A, B, C, D of concentric absorber members, only the absorber system 18 being shown in FIG. 5 for sake of clarity. Thus, layer A has three concentric members designated A*a*, A*b*, A*c*, layer B has three concentric members designated B*a*, B*b*, B*c*, and so forth. For sake of clarity, the height H2 of system 18 is shown exaggerated compared to its diameter D2. In practice, H2 is substantially the same or less than D2. By judiciously selecting at least two or more different radiation absorption density characteristics for the components in at least one of the layers A, B, C, D, both the lateral and the longitudinal radiation absorption density characteristic is varied for the antenna 10.

It should be noted that in the absorber system 18 of the embodiment of FIGS. 4 - 5, that while certain layers have different heights, e.g. layers A and B, the individual members in any particular layer each have the same height. Moreover, in the embodiment of FIGS. 4 - 5, each layer A, B, C, D has the same number of concentric members, to wit: three, and moreover, correspondingly positioned members of the layers have the same inner and outer diameters. Thus, outer positioned members A*a*, B*a*, C*a*, D*a* are shown as all having equal inner diameters, as well as equal outer diameters. Likewise, intermediate members A*b*, B*b*, C*b*, D*b* have equal inner and outer diameters, and the inner members A*c*, B*c*, C*c*, D*c* also have equal inner and outer diameters. However, other configurations are possible, as will be apparent to those skilled in the art, from the description hereinafter of the other embodiments. In the next described embodiments of FIGS. 6 - 8, 10, only the absorber systems are shown, for sake of clarity, the respective longitudinal centers of axes of the associated antennae being designated U3 - U6, respectively.

Figure 6:
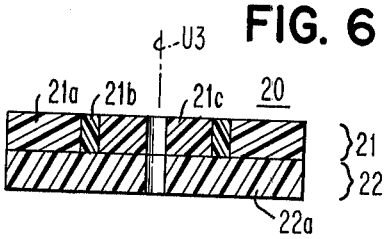
FIG. 6 is a cross-sectional view of another embodiment of the present invention.

As shown in FIG. 6, the absorber system 20 of the embodiment thereof has an upper layer 21 of three concentric absorber members 21*a*, 21*b*, 21*c*, each of a different radiation absorption density characteristic, and a lower layer 22 of a single absorber member 22*a*. The latter has an outside diameter equal to the outside diameter of outer member 21*a* and an inside diameter equal to the inside diameter of inner member 21*c*.

Figure 7:
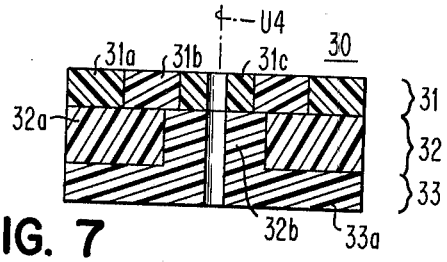
FIG. 7 is a cross-sectional view of still another embodiment of the present invention.

In FIG. 7, the embodiment thereof has an absorber system 30 of three layers 31, 32, 33. The top layer 31 has three discrete absorber members 31*a*, 31*b*, 31*c*. Bottom layer 33 has an absorber member 33*a* which has an integral hub-like portion 32*b*. Portion 32*b* is aligned with and part of the layer 32 and is concentric with the other member 32*a* of layer 32. Again, by judiciously selecting the radiation absorption densities of the members 31*a*, 31*b*, 31*c*, 32*a* and 33*a*, and hence, portion 32*b*, so that they are different for at least two members in at least one of the layers, the lateral, as well as the longitudinal, radiation absorption density characteristic of system 20 is variable. Moreover, it should be noted that the outer diameter of portion 32*b* and the inner diameter of member 32*a* are not aligned with any of the diameters of the members of layer 31. This allows even more close matching of the composite absorption density characteristic both laterally and longitudinally to the desired antenna gain pattern.

Figure 8:
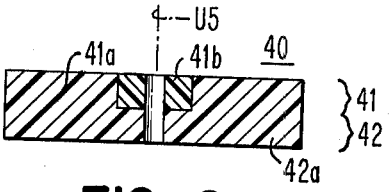
FIG. 8 is a cross-sectional view of still another embodiment of the present invention.

The embodiment of FIG. 8 shows an absorber system 40 having two layers 41, 42. The member 42*a* is circularly recessed inwardly at the center of its upper face so that the inner member 41*b* of layer 41 is concentrically mounted in the recess. The ring-like portion 41*a* of member 42*a* which encompasses member 41*b* is considered to be part of layer 41 and thus, for different radiation absorption densities for members 41*b* and 42*a*, variable lateral and longitudinal radiation absorption characteristic is provided in the system 40.

Figure 9:
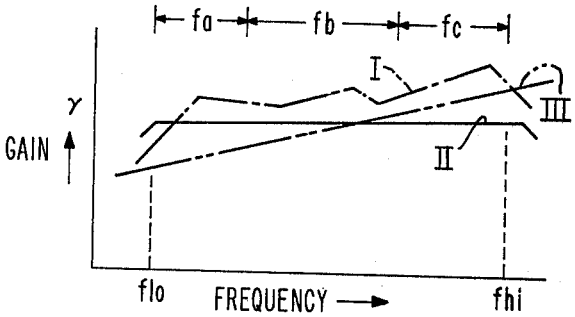
FIG. 9 is a waveform diagram illustrating idealized waveforms helpful in understanding the principles of the present invention.

The operation of unidirectional spiral antennae is well-known to those skilled in the art. Briefly, the antenna operates over a broad frequency band f*lo* to f*hi*. For example, operation over the f*lo*=2 to f*hi*=18 gigahertz range is typical. Moreover, the outer turns of the spiral antenna conductors, e.g. conductors 2*a*, 2*b* of FIGS. 1 - 3, are generally associated with the lower frequencies, the intermediate turns with the intermediate frequencies, and the inner turns with the higher frequencies. By way of example, there is shown in FIG. 9, idealized waveforms which help illustrate the principles of the present invention using the embodiment of FIGS. 1 - 3.

Waveform I shown in dash dot form represents the absolute gain versus frequency characteristic of antenna 1 without the absorber system 8 over the operational frequency band flo to fhi. By judiciously selecting density levels of predetermined values in the respective components 8*a*, 8*b*, 8*c* for sub-bands f*a*, f*b*, f*c*, respectively, a uniform characteristic illustrated by the solid line waveform II is provided for antenna 1. Alternatively, each component 8*a*, 8*b*, 8*c* may be provided with different densities so that the gain increases with frequency, as shown by the dash-dot dot line III. Alternatively, different densities can be selected so that the gain of one or two of the three sub-bands *fa*, *fb*, *fc* is surpressed, i.e. attenuated, while the other or others is favored. Moreover, the absorber system 8 can be modified so as to include, for example, any predetermined plural number of concentric members and a corresponding plural number of frequency sub-bands. Moreover, where there are one or more additional layers, either single component, as for example the layer 22 of FIG. 6, or plural component as for example the layer of FIGS. 4 - 5 of the layer 32 of FIG. 7, even further frequency sub-band allocation is provided.

Figure 10:
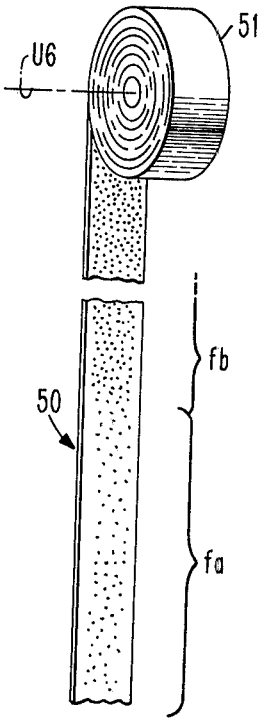
FIG. 10 is a perspective view of still another embodiment of the present invention.

It should be understood that while the embodiments of FIGS. 1 - 8 preferably are practiced with discrete concentric components for the absorber systems thereof, the invention may be practiced in other forms. For example, as shown in FIG. 10, any given layer can be formed in an elongated thin strip 50 which is allocated into predetermined zones corresponding to predetermined frequency sub-bands *fa*, *fb*, etc. Each zone is provided with a predetermined density of absorber material corresponding to the overall characteristic of the antenna pattern desired, e.g. a graduated increasing density from the lower frequency zone *fa* to the higher ones *fb*, etc. This can be done, for example, by progressively increasing the dosage of the absorber particles as the particles are being added to the carrier matrix in its uncured state and which matrix is in the form of a planar elongated strip during this operation. After curing, the strip is wound into a coil 51, as is partially shown in FIG. 10. Thus, the fully wound coil 51 also is provided with a laterally transverse radiation absorption density characteristic in accordance with the principles of the present invention.

On the other hand, commercially available flexible foam sheets of microwave absorber, such as those available under the aforementioned trademark Eccosorb, such as Eccosorb LS, can be used to fabricate a discrete component absorber system. These sheets are available in various thicknesses and with different absorption losses expressed in decibels or db and which are correlated to absorber densities in a manner well-known to those skilled in the art. The components are stamped out of the sheet in the desired sizes. For example, in one absorber system made in accordance with the principles of the present invention, the top layer had two concentric cylindrical components. The outer component of the upper layer had an insertion loss of 9.0db and a nominal outside diameter or O.D. of 3.7 inches or approximately 9.40 centimeters, and an inner diameter or I.D. of one inch or approximately 2.54 centimeters, and a height of $\frac{3}{8}$ of inch or approximately 0.953 centimeters.

The inner component of the top layer had an O.D. approximately slightly less than the I.D. of the outer component and was of the same height as the outside component. However, it had an absorption loss of 12.0 db. The absorber system also included five additional layers, each having a single component and having nominally equivalent O.D.s and heights of 3.7 inch and ⅛ of inch, respectively, or approximately 9.40 centimeters and 0.318 centimeters, respectively. The insertion loss for the five layers in sequence from the one closest to the two component top layer to the one remote therefrom, is as follows: 7.5 db, 10.5 db, 13.0 db, 13.0 db and 13.0 db. The I.D. of the inner component of the top layer and the components of the lower layers are equivalent and nominally ⅛ of an inch or approximately 0.318 centimeters. This absorber system is used in a spiral antenna system and provides it with a certain tailored gain over the frequency band 2 to 11 gigahertz.

Figure 11:
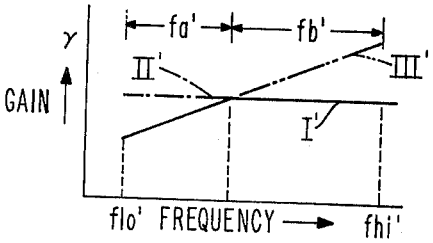
FIG. 11 is a waveform diagram illustrating idealized waveforms helpful in understanding the principles of the present invention.

By way of example, there is shown in FIG. 11 idealized waveforms for a two-concentric component top-layer absorber system having a frequency band *flo'* to *fhi'* and sub-bands *fa'*, *fb'*. It is assumed that the solid line waveform I' represents the absolute gain pattern of the antenna when the outer concentric component has a specific db loss different from that of the inner component. In this case, the gain is linearly increasing in sub-band *fa'* and is uniform in sub-band *fb'*. By substituting another outer component with a predetermined different density characteristic, a uniform gain can be provided in the band *fa'* which matches the uniform gain in band *fb'*, as shown by waveform II'. Alternatively, by substituting another inner component with a predetermined different density characteristic, a linear increasing gain band *fb'* can be provided which matches that of band *fa'*.

While the invention has been particularly shown and described with reference to preferred embodiments thereof, it will be understood by those skilled in the art that the foregoing and other changes in form and details may be made therein without departing from the spirit and scope of the invention.

We claim:

1. A unidirectional spiral antenna comprising:

spiral antenna circuit means, insulator means for supporting said circuit means, electrical connector means coupled to said circuit means, electrically conductive reflector cavity means juxtaposed adjacent to said insulator means, and radiation absorber means disposed in said cavity means and having a predetermined lateral variable radiation absorption density characteristic.

2. A unidirectional spiral antenna according to claim 1 wherein said radiation absorber means comprises at least one layer of plural concentric member means, at least two of said plural concentric members having different radiation absorption densities.

3. Unidirectional spiral antenna apparatus comprising:

a spiral antenna circuit having a pair of interleaved spiral configured flat conductors, a planar insulator substrate having first and second surfaces and said flat conductors mounted on said first surface thereof, electrical connector means coupled to said flat conductors, a conductive reflector cavity having an open end thereof juxtaposed to said second surface, and a radiation absorber system disposed in said cavity and having a predetermined lateral variable radiation absorption density characteristic.

4. Unidirectional spiral antenna apparatus accordng to claim 3 wherein said radiation absorber system comprises at least one layer of plural concentric members, at least two of said plural members having different radiation absorption densities.

5. Unidirectional spiral antenna apparatus comprising:

a pair of printed circuit conductors configured as a spiral antenna circuit, a circular dielectric substrate having said pair of printed circuit conductors mounted thereon, electric connector means coupled to said printed circuit conductors, a cylindrical conductor reflector cavity having an open end juxtaposed to said substrate, and a cylindrical radiation absorber system disposed in said cavity and having a predetermined radial variable radiation absorption density characteristic.

6. Unidirectional spiral antenna apparatus according to claim 5 wherein said radiation absorber system comprises at least one layer of plural concentric cylindrical members, at least two of said plural members having different radiation absorption densities.

* * * * *